United States Patent [19]

Benoist et al.

[11] 4,247,257

[45] Jan. 27, 1981

[54] ROTOR FLANGES OF TURBINE ENGINES

[75] Inventors: Josette Benoist, Le Mee sur Seine; Pierre A. Glowacki, Melun; Gérard M. F. Mandet, Epinay sous Senart, all of France

[73] Assignee: Societe Nationale d'Etude et de Construction de Moteurs d'Aviation, Paris, France

[21] Appl. No.: 15,937

[22] Filed: Feb. 28, 1979

[30] Foreign Application Priority Data

Mar. 8, 1978 [FR] France ..... 7706602

[51] Int. Cl.[3] ..... F01B 5/32

[52] U.S. Cl. ..... 416/221; 416/220 R; 416/95

[58] Field of Search ..... 416/220 R, 220 A, 221, 416/95

[56] References Cited

U.S. PATENT DOCUMENTS

| | | | |
|---|---|---|---|
| 2,925,997 | 2/1960 | Hart et al. | 416/220 |
| 3,295,825 | 1/1967 | Hall | 416/221 |
| 3,807,898 | 4/1974 | Guy et al. | 416/221 |
| 4,189,282 | 2/1980 | Benoist et al. | 416/221 |

FOREIGN PATENT DOCUMENTS

| | | |
|---|---|---|
| 1158244 | 6/1948 | France . |
| 2324873 | 4/1977 | France . |

*Primary Examiner*—Louis J. Casaregola
*Attorney, Agent, or Firm*—Bacon & Thomas

[57] ABSTRACT

The rim of a turbine disc is provided with a circular collar upon which is engaged the heel of an annular flange having a U-shaped cross section with unequal sectors, i.e., a principal piece forming a circlip and a smaller piece forming a key which completes the flange following the installation of the circlip; the key is retained in its position by cuts of the ends of said key.

10 Claims, 13 Drawing Figures

ROTOR FLANGES OF TURBINE ENGINES

BACKGROUND OF THE INVENTION

The invention concerns the rotors of axial turbine engines of the type comprising a disk or a drum having a rim equipped with a plurality of longitudinal, profiled grooves wherein the roots of the rotor blades of the turbine engine are engaged. The roots of the blades of the turbine engines of this type are secured by annular flanges, whereby they are prevented from leaving by way of the ends of the grooves. The invention concerns more precisely the flanges mentioned above and applies specifically to the downstream flange of a gas turbine with a rotor cooled by means of air circulation.

The cooling air, generally taken from the air flow delivered by the compressor for a group of gas turbines, is conducted into feed cavities provided in the turbine disk, then traverses cooling canals of the blades, together with spaces bounded on the outside by the platforms for the blades and internally by the apexes of the teeth of the disk, between the grooves. The cavities and the spaces are normally supplied with air from upstream and therefore leaks in the downstream direction must be prevented. In addition to securing the roots of the blades, the downstream flange must thus insure the air tightness of the feed cavities and the spaces in the downstream direction. The flange also serves as a thermal shield. The flanges must be as light as possible so that they will not generate excessive centrifugal stresses in the disk. Furthermore, they must not generate local stresses in the disk or the blades. This consideration leads to the elimination of the fastening of the flanges by means of bolts, because the holes necessary for the passage of the bolts are locations of stress concentrations; also, such bolts and nuts would form a relief pattern on the surface of the rotating disk, which through friction with the ambient air, would produce heating harmful to the mechanical strength of the rotor.

SUMMARY OF THE INVENTION

It is the object of the present invention to provide a flange capable of satisfying the several conditions considered hereinabove and retaining simplicity of design. It is another object of the invention to provide a flange applied forcefully against the front face with respect to the turbine disk, this being particularly important in the case of the downstream disk, which simultaneously must assure air tightness, as explained earlier, and oppose the thrust of the blades forced in the downstream direction by the motive fluid.

According to the present invention, the rim of the disk or drum of the turbine engine forms at least on one side (preferably on the downstream side), between the front face of the rim and a circular groove provided in its internal periphery, an annular collar engaged by the bead of an annular flange having the configuration of a U with unequal arms, the small arm forming a hook engaging said groove and the larger arm forming an annular disk extending along said frontal face, with said annular flange being divided into two unequal sectors forming respectively a principal piece which extends over the major part of its circumference and is engaged elastically upon said collar in the manner of the circular clamps called "circlips" and a smaller piece forming a key which completes the flange following the installation of the principal piece, while retaining means are provided to keep the key from escaping from the rim inwardly.

Advantageously, the annular flange is of a configuration such that the center of gravity of its cross section is located in the large arm of the U. Because of this particular condition, the centrifugal forces tend to tilt the flange in the direction wherein the part is applied in the form of an annular disk against the front surface of the rim and the roots of the blades, thus insuring the tightness of the cavities and spaces wherein the cooling air circulates, together with the axial retention of the blades. Preferably, the annular flange is locked in rotation by means of at least one spur of the portion in the form of an annular disk of the principal piece, aligned axially and engaging a recess provided in the rim, for example at the interface between a blade root and its groove.

The retention of the key may be assured in a number of ways. Specifically, the ends of the key may be cut so that said ends are maintained in place by the ends of the principal piece. In one embodiment, the division between the principal piece of the annular flange and key is created on the one side by a bevel cut inclined toward the inner periphery of the key, and on the other side by a broken line cut forming in the key an extruding external portion and a recessed inner portion. In a variant, the division is obtained on both sides by bevel cuts inclined toward the inner periphery of the key and the flange is advantageously slit by notches which increase its flexibility. In another variant, cuts on either side of the key define substantially parallel flanks which are locked against the adjacent flanks of the principal piece by a mortise and tenon assembly.

In another mode of embodiment, the two cuts are inclined toward the outer periphery of the key, so that said key may be inserted and withdrawn, from the inside to the outside between the ends of the principal piece, and the key is locked in place by an elastic clamp (or "clip") of piano wire, whereby the curved ends of said piano wire are hooked respectively in two recesses provided each at the interface between a root of a blade and its groove, said clamp forming a protuberance maintaining it in place and engaging a hollow of the key.

The description to be presented hereinafter with reference to the drawings attached hereto, given as non-limiting examples, will provide a better understanding of the advantages of the invention and its mode of embodiment; with all particularities issuing from both the text and drawing being within the scope of the invention.

DESCRIPTION OF THE PREFERRED EMBODIMENTS

Figure 1:
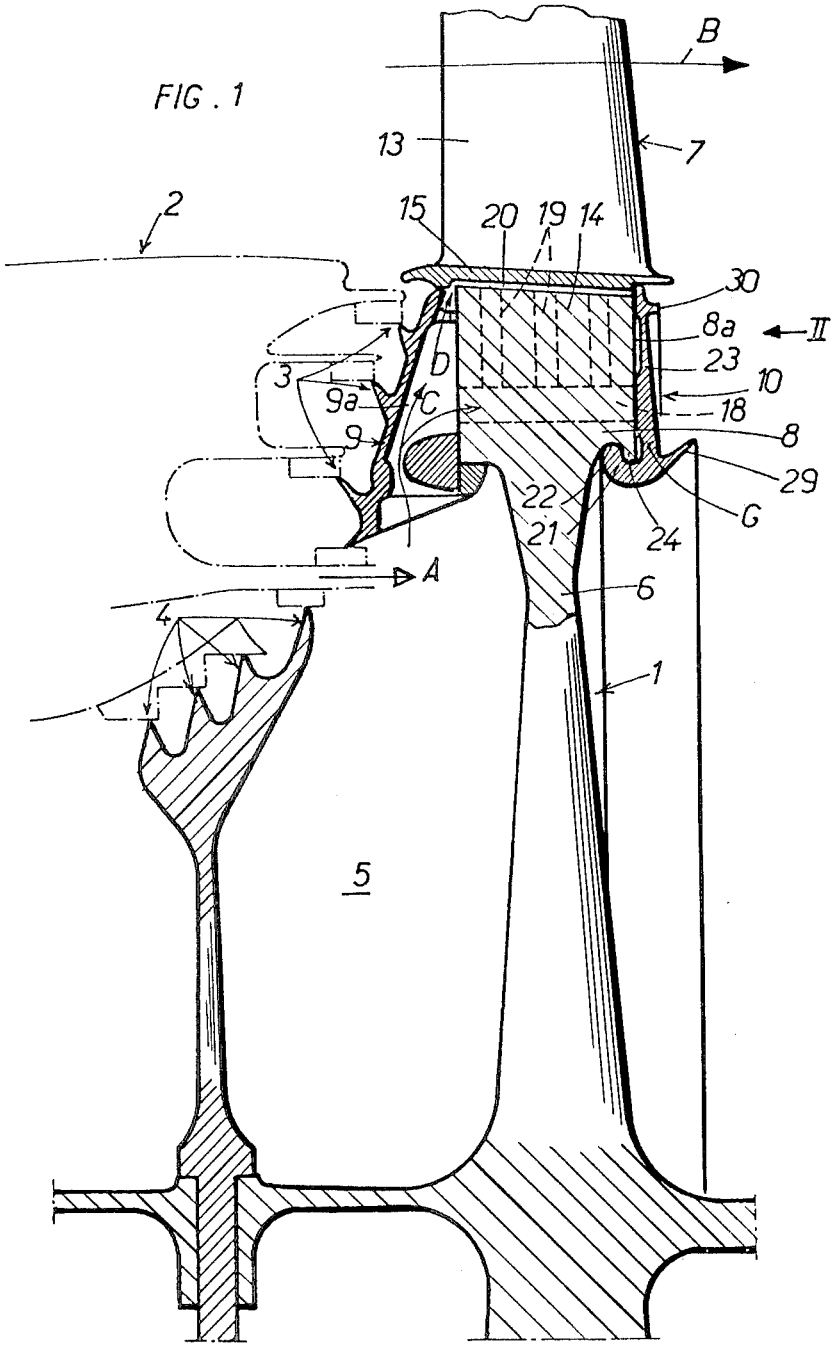
FIG. 1 is a view, in a schematic axial section, of a portion of a gas turbine, showing a turbine disk equipped with a downstream flange according to the invention.

In FIG. 1, there is shown a part of the rotor 1 of an axial flow turbine being a part of a group of gas turbines (not shown in its entirety). The rotor cooperates with a stator 2, by means of a labyrinth seal 3, 4 to form a tight chamber 5 capable of being supplied with cooling air (indicated schematically by the arrow A) originating in a compressor (not shown) for the group of gas turbines.

The rotor 1 comprises essentially a disk 6 carrying on its periphery a crown of blades 7 moved by a flow of hot air indicated schematically by the arrow B, and two coaxially annular flanges on the disk 6, arranged on either side of the rim 8 of the disk, i.e., in the form of an upstream flange 9 and a downstream flange 10. In the embodiment shown, the upstream flange 9 is analogous to the flange described in French patent application No. 75.28440 (published under Pat. No. 2 324 873) and the downstream flange embodies the present invention and rests, as will be explained hereinafter, on a downstream frontal face 8*a* of the rim 8, said frontal face 8*a* being machined in a transverse plane perpendicular to the axis (not shown) of the rotor.

Figure 3:
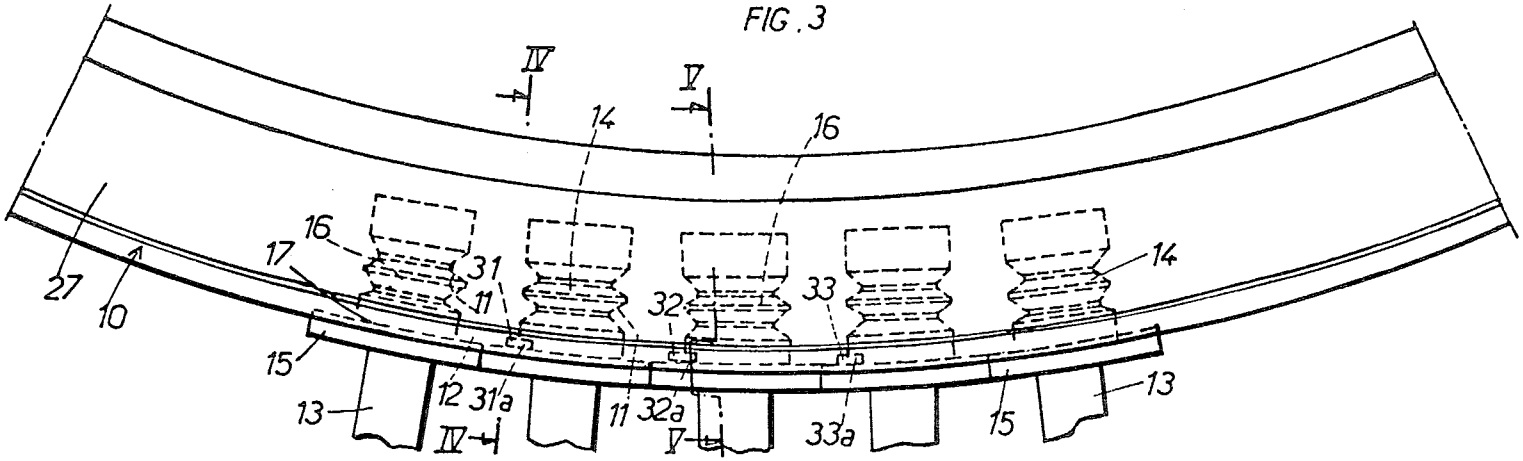
FIG. 3 shows, as seen from the downstream direction, a part of the downstream flange and the disk of the turbine diametrically opposed to the key shown in FIG. 2.
Figure 4:
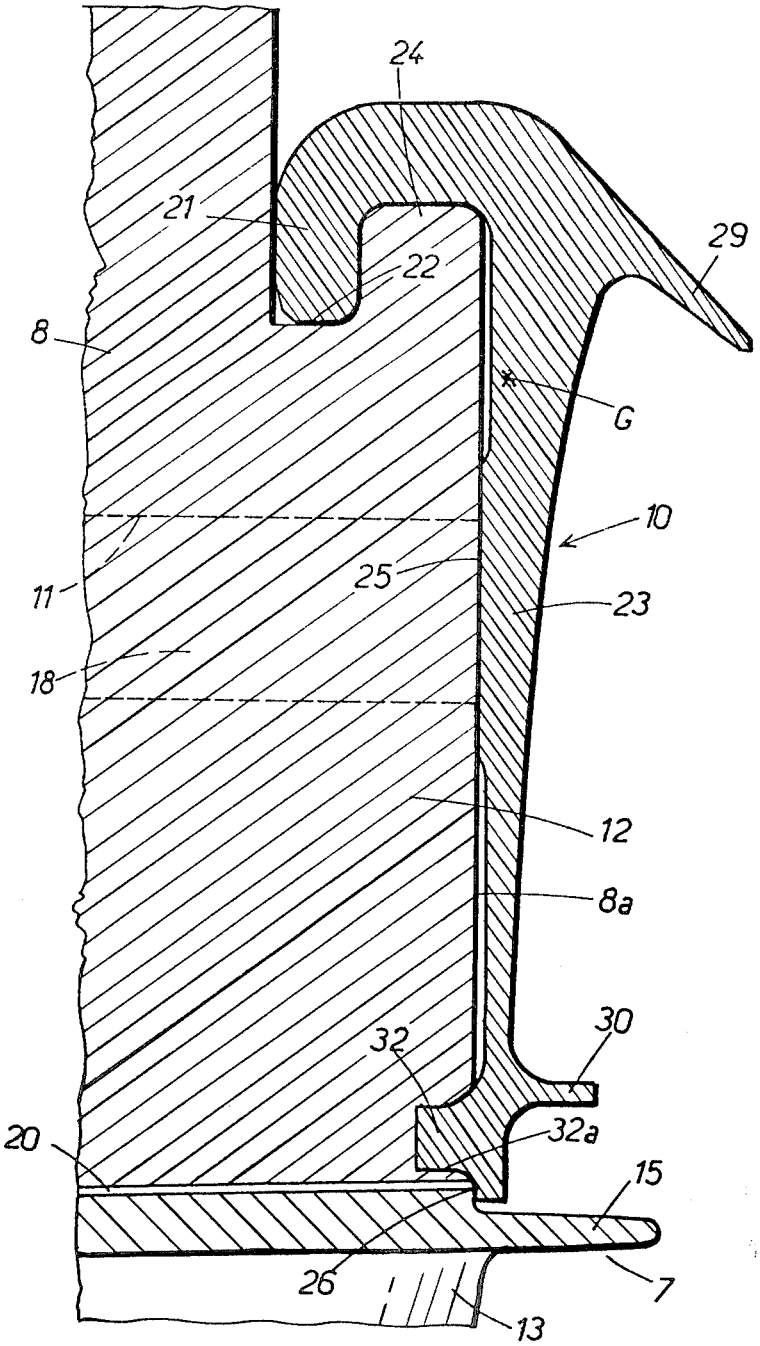
FIGS. 4 and 5 are partial sectional views, on a larger scale, taken on the lines IV—IV and V—V, respectively of FIG. 3.
Figure 7A:
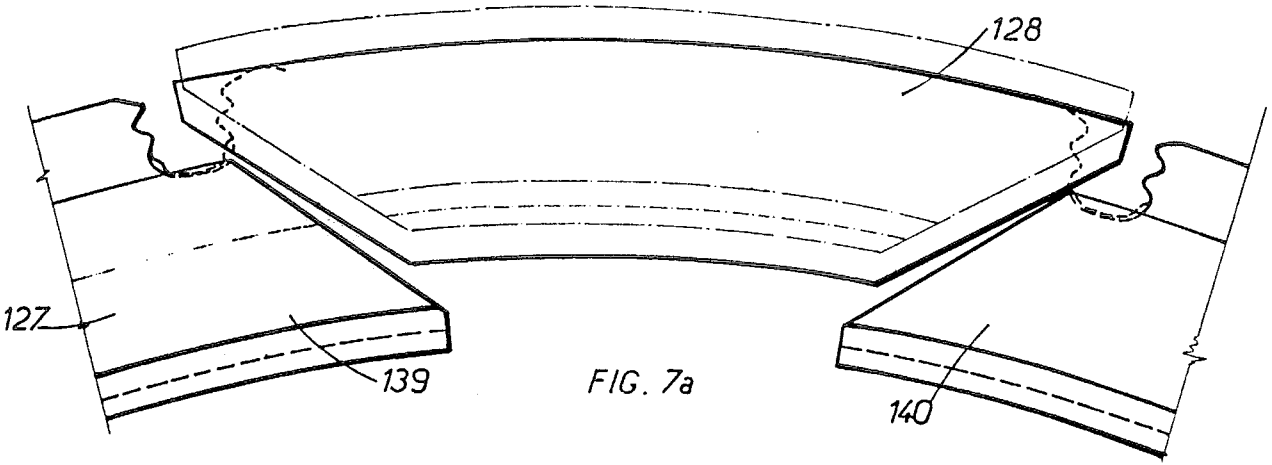
FIG. 7*a* is a view analogous to FIG. 7, illustrating the installation of the key.
Figure 7:
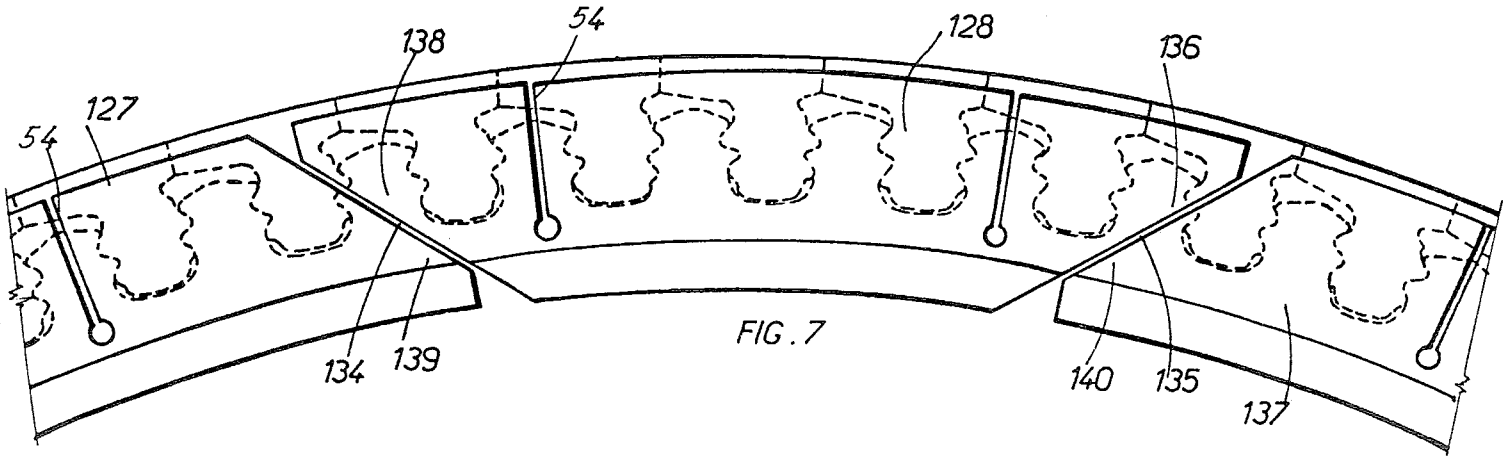
FIG. 7 is a similar view to FIG. 2, showing a variant.

Profiled grooves 11 (FIG. 3) are provided on the periphery of the rim 8, which in the embodiment represented particularly in FIG. 7, consist of fir-tree drift apertures extending from one frontal face to the other of the rim, said apertures defining between them the teeth 12 of the disk (FIGS. 3 and 4). Each blade 7 has (FIG. 5) an active part 13 projecting into the flow channel B of the hot gases of the turbine, and a foot 14 separated from the active part by a platform 15. The foot itself comprises an inner part or "root" 16 (FIG. 3) having a profile complementary to that of the grooves 11 of the rim, and an intermediate part or "pole" 17 extending radially slightly beyond the teeth 12 of the disk and constituting the transition between the attachment and the profile of the blade. Each foot 14 of a blade comprises a planar, downstream frontal face 14*a* (FIG. 5), which as shall be explained hereinafter, is maintained in the plane of the frontal face 8*a* of the rim 8 by the flange 10.

Figure 5:
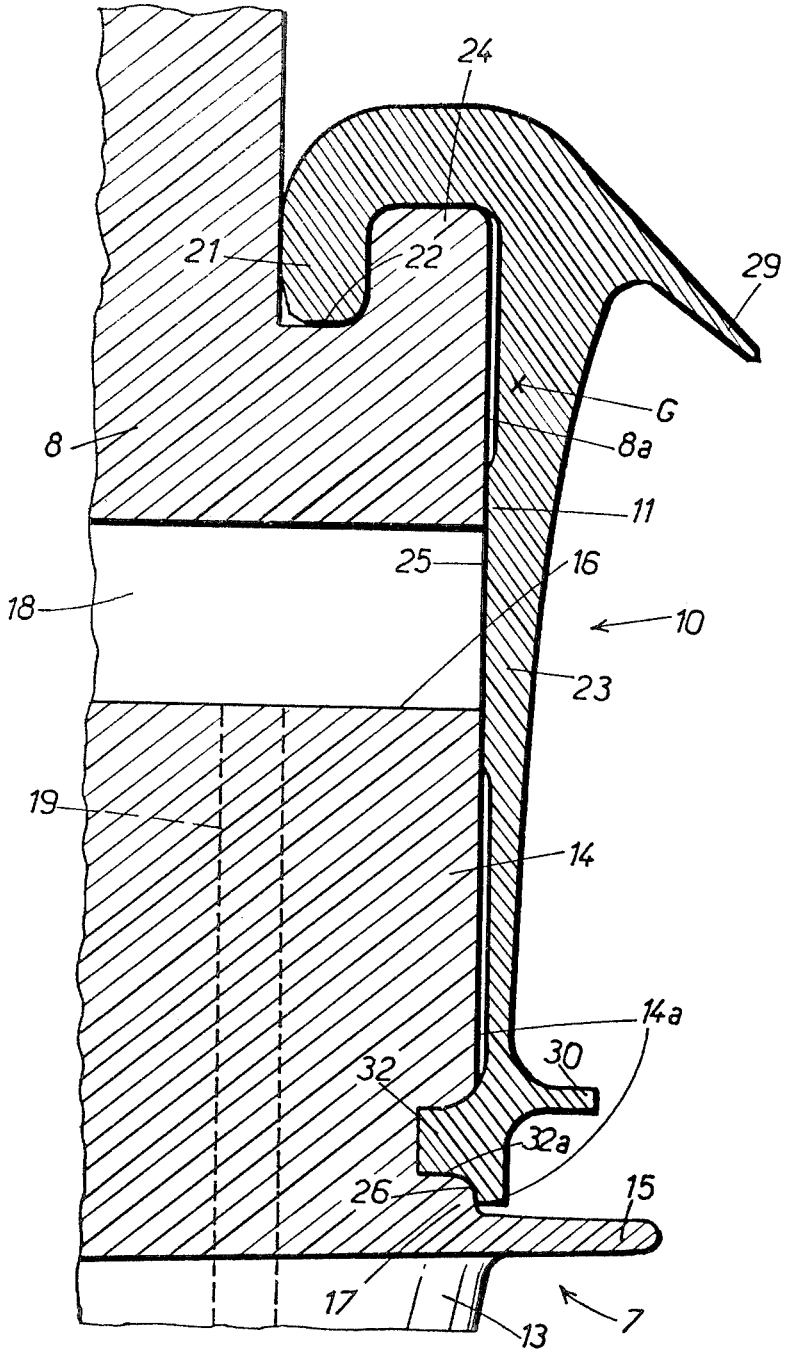

As may be seen particularly in FIGS 1 and 5, there exists, between the base of the root 16 of each blade and the bottom of the corresponding groove 11, a free space 18 which communicates with the chamber 5 by means of a passage 9*a* machined into the upstream flange 9, with the cooling canals 19 of the blade opening into said passage 9*a*. The cooling air arrives in the chamber 5 in the direction of the arrow A, as explained hereinabove, then passes, as shown by arrow C, into the space 9*a* and the feed cavities 19. There exists further, between the platforms 15 and the teeth 12, the spaces 20 in the form of sectors separated by the intermediate parts 17 of the feet of the blades, said spaces being supplied by air, as shown by the arrow D, from the passage 9*a*. The feed cavities 18 and the volumes formed by the spaces 20 open onto the downstream face 8*a* of the rim 8 through orifices which are sealed by the downstream flange 10, as shall be explained later herein.

The downstream flange 10 (FIGS. 1, 4 and 5) is an annular flange of a U configuration with unequal arms and its concavity facing radially outward, the short arm of the U forming a hook 21 which engages a circular groove 22 machined into the inner periphery of the rim 8, while the longer arm forms an annular flange 23 extending along the downstream frontal face 8*a* of the rim 8, with the annular flange thus capping an annular collar 24 formed at the inner periphery of the rim 8 between the groove 22 and the downstream face 8*a*. The surface of the annular disk 23, which is turned toward the rim 8, comprises two protruding parts 25 and 26, which cover the orifices of the cavities 18 (FIG. 5) and of the spaces 20, said parts being machined so that they may bear directly against the planar face 8*a* of the rim 8.

Figure 2:
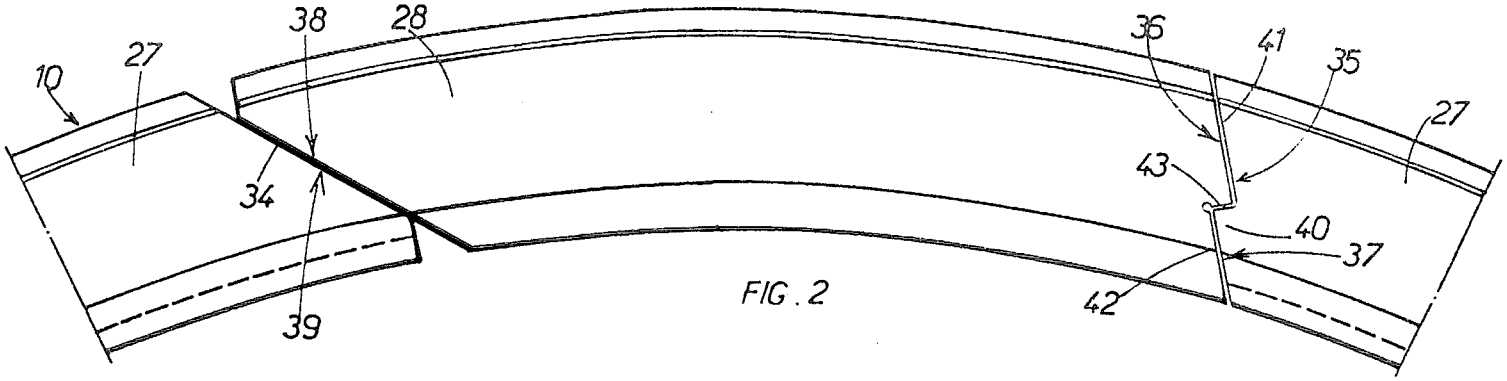
FIG. 2 shows a part of the downstream flange, viewed from the downstream direction, in the direction of the arrow II of FIG. 1.

It is evident that the flange 10 could not be installed if it consisted of a single piece. It is, therefore, divided into two unequal sectors forming respectively a principal piece such as 27 (FIG. 2) which extends over the major part of its circumference and is clamped elastically to the collar 24 in the manner of a "circlip" and a smaller piece, such as 28, forming a key which completes the flange 10 following the installation of the principal piece 27.

As may be seen in FIGS. 1, 4 and 5, the center of gravity G of the cross section of the flange 10 is located in the long arm 23 so that during operation the centrifugal forces generated in the flange 10 entrained in rotation by the disk of the turbine 1, tend to tilt the flange in a direction which presses the annular disk 23 against the rim 8, the planar parts 25 and 26 thus being applied tightly against the planar downstream face of the rim 8 and against the planar downstream faces 14*a* of the feet of the blades, said blades being urged in the downstream direction by the flow of gas B. It thus may be seen that the projections 25 and 26 serve simultaneously as stops for the feet 14 of the blades and as tight stoppers or seals for the orifices of the cavities 18 and the spaces 20 at the planar face 82.

The flange 10 comprises on its downstream side, adjacent to its inner periphery, a circular appendix 29 in the form of a lip having the shape of a truncated cone, which cooperates with an element, not shown, of the stator 2 to form a labyrinth seal similar to the seals 3 and 4, and, in the vicinity of its external periphery, a cylindrical appendix 30. The principal piece or circlip 27 carries on its upstream face, preferably in its external peripheral part diametrically opposed to the key 28, at least one spur (FIGS 3, 4, 5). In FIG. 3, three spurs 31, 32, 33 are shown; they are arranged to hook into the recesses 31*a*, 32*a*, 33*a*, each located at the interface between a tooth 12 of the disk and a foot of a blade 14, thus locking the flange 10 in rotation.

The principal piece 27, which extends over the major part of the circumference of the flange 10, is maintained in place on the annular collar 24 of the rim 8 by elasticity (and also by the spurs 31, 32, 33), but the key 28 itself would escape toward the inside of the rim 8, if no precautions are taken to restrain it. For this purpose, in the embodiment of FIG. 2, the division between the principal piece 27 and the key 28 is effected on the one side by a bevel cut 34 appreciably inclined toward the inner periphery of the key, and on the other side by a broken line cut 35 forming a protruding external part 36 in the key and a recessed inner portion 37. These cuts are effected for example by "wire" EDM (electric discharge machining). The bevel cut 34 thus forms in the key 28 a bevelled outer part 38 which, when the flange 10 is in place, is prevented from moving toward the inside of the rim 8 by the inner bevelled part 39 of the piece 27, while the outer protruding part 36 of the key is kept from moving toward the inside by the protruding inner part 40 of the piece 27. In the embodiment shown, the bevel cut 34 is inclined at approximately 50° with respect to the radius of the flange 10, toward the inner periphery of the key 28, and the broken line cut 35 comprises two parallel segments 41, 42 which are inclined at approximately 25° toward the outer periphery of the key and connected by means of a short perpendicular segment 43. In addition, the noses of the bevelled parts 38 and 29 are in the shape of a truncated cone.

Figure 6:
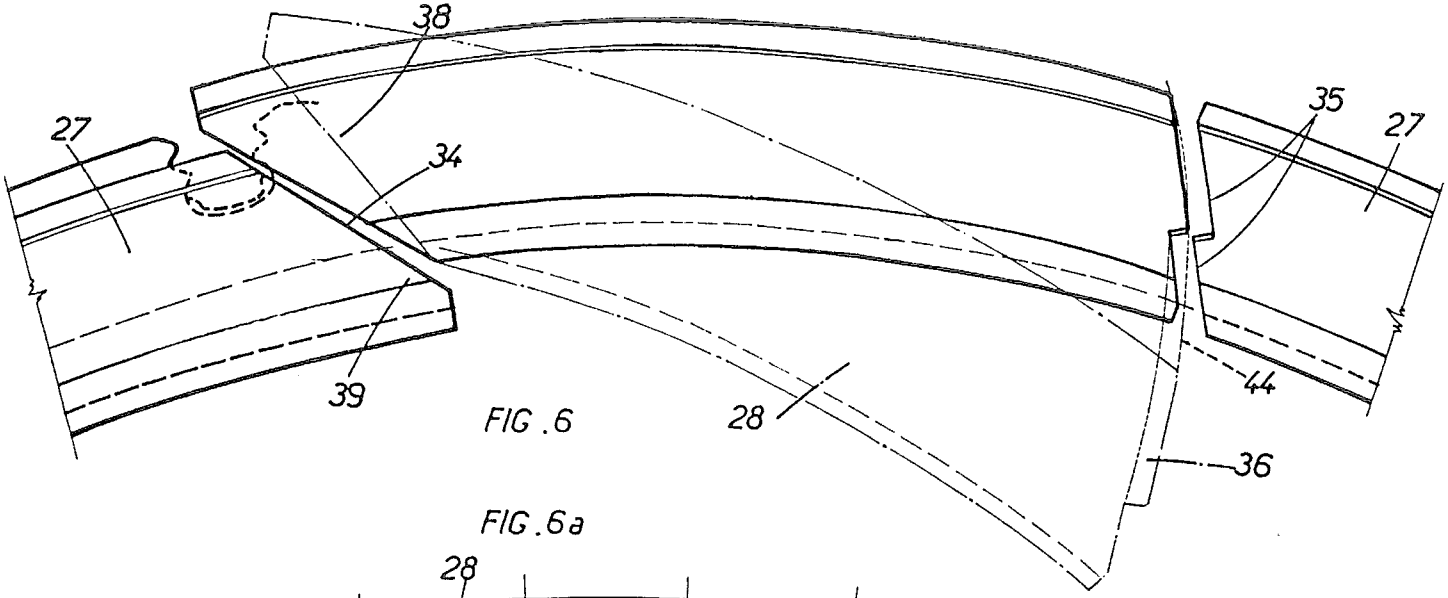
FIGS. 6 and 6*a* are similar views to FIG. 2, illustrating the installation of the downstream flange.
Figure 6A:
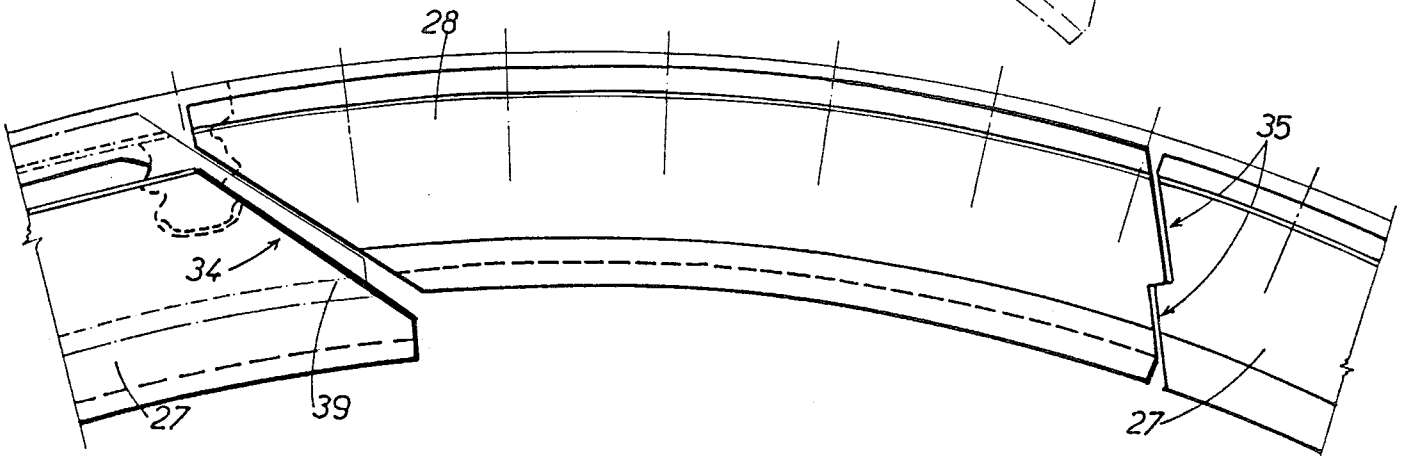

FIGS. 6 and 6*a* illustrate the steps for the installation of the key 28. The bevelled beak 39 of the piece 27 is pulled toward the inside by means of pliers, while keeping the circlip at the bottom of the groove to prevent its tangential displacement. In order to maintain the circlip at the bottom of the groove, it is immobilized, also by means of a tool, at two points located at 90° on either side of the beak 39. The heel of the bevelled portion 38 of the key 28 is then slid toward the outside, on the cut 34 of the piece 27, until said heel engages the annular collar 24 of the rim 8, with the protruding part 36 of the key remaining inside the circular inner periphery of the piece 27 (position indicated by the dash-and-dot line in FIG. 6). The key 28 is then rotated toward the outside by abutting against the cut 34 of the piece 27, until its heel covers the annular collar 24 (position indicated by the solid line); it may be seen in FIG. 6 that during this movement the path 44 of the protruding portion 36 clears the cut 35 of the piece 27. At the end of the movement, the elements 27 and 28 are in the position shown by a solid line in FIG. 6*a* and it suffices to release the force drawing the beak 39 of the piece 27, for it to take its final place, shown by the dash-and-dot line. The reverse procedure is followed to remove the flange 10.

In the embodiment of FIG. 7, wherein the elements playing the same role as in FIG. 6, are designated by the same reference numbers increased by 100 units, the cut 134 is similar to the cut 34 and the cut 135 is symmetrical to the cut 134. The noses of the bevelled parts 138 and 139 are truncated as are those of the bevelled parts 136 and 140, respectively, symmetrical to the former. In addition, the pieces 127 and 128 are slit by radial notches 54 regularly distributed over the circumference of the flange 10, thus increasing the flexibility of the latter. To install the key 128, the end portions 139 and 140 of the piece 127 are drawn toward the inside by means of pliers (position shown in FIG. 7*a*), thus clamping the piece 127 in place in the section diametrically opposed to the key, and the heel of the key 128 is placed on the annular collar 24 of the rim 8 by inserting the key between the end parts 139 and 140 and subsequently pushing it toward the inside. Alternatively, it is also possible to draw only one of the ends 139 or 140 toward the inside. The pieces 127 and 128 then assume their final positions when the force drawing the end parts of the piece 127 is relaxed.

Figure 9:
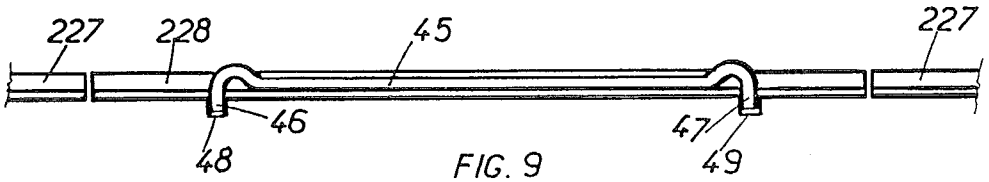
FIG. 9 is a sectional view taken o the line IX—IX of FIG. 8.
Figure 8:
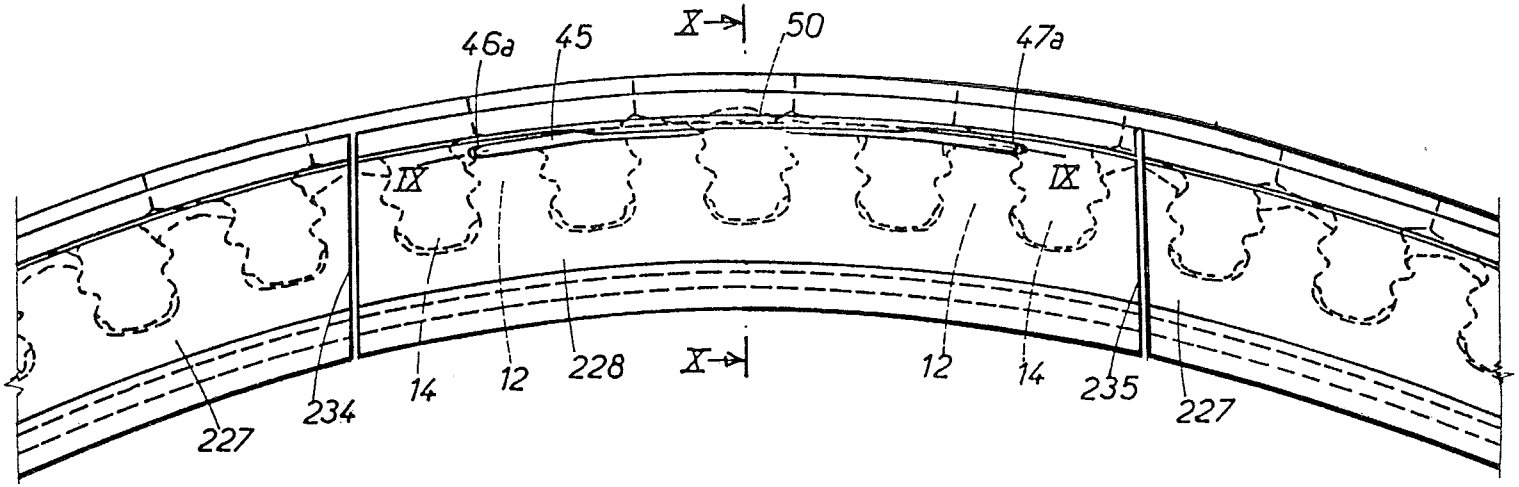
FIG. 8 is a view analogous to that of FIG. 7, showing another embodiment of the downstream flange.
Figure 10:
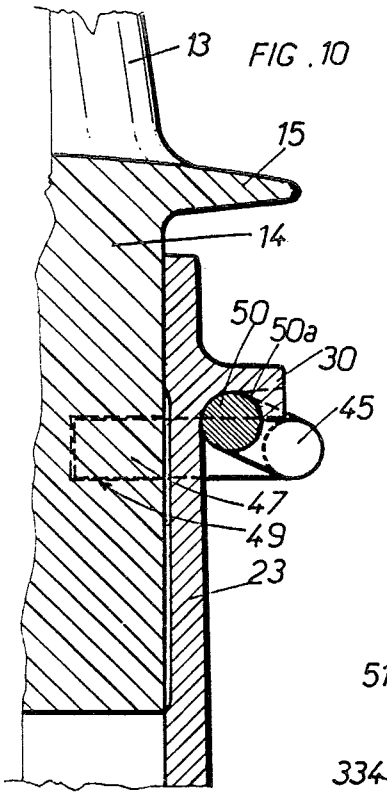
FIG. 10 is a sectional view on a larger scale taken on line X—X of FIG. 8.

In the embodiment of FIGS. 8 to 10, the two cuts 234 and 235 are again symmetrical bevel cuts, but are inclined toward the outer periphery of the key 228, so that they may be installed, from the inside toward the outside, between the ends of the piece 227. The key 228 thus would be able to escape toward the inside of the rim 8, but it is prevented from doing so by an elastic piano wire hook 45, having ends bent at right angles and engaged, from downstream toward upstream, through the holes 46*a*, 47*a* of the key 228, in the recesses 48, 49, each provided at the interface between a tooth 12 of the disk of the turbine and the foot 14 of a blade. The elastic hook 45 additionally comprises, in the center of its length, a protruding loop 50, which is engaged elastically in a recess 50*a* provided at the root of the cylindrical appendix 30 of the key 228.

Figure 11:
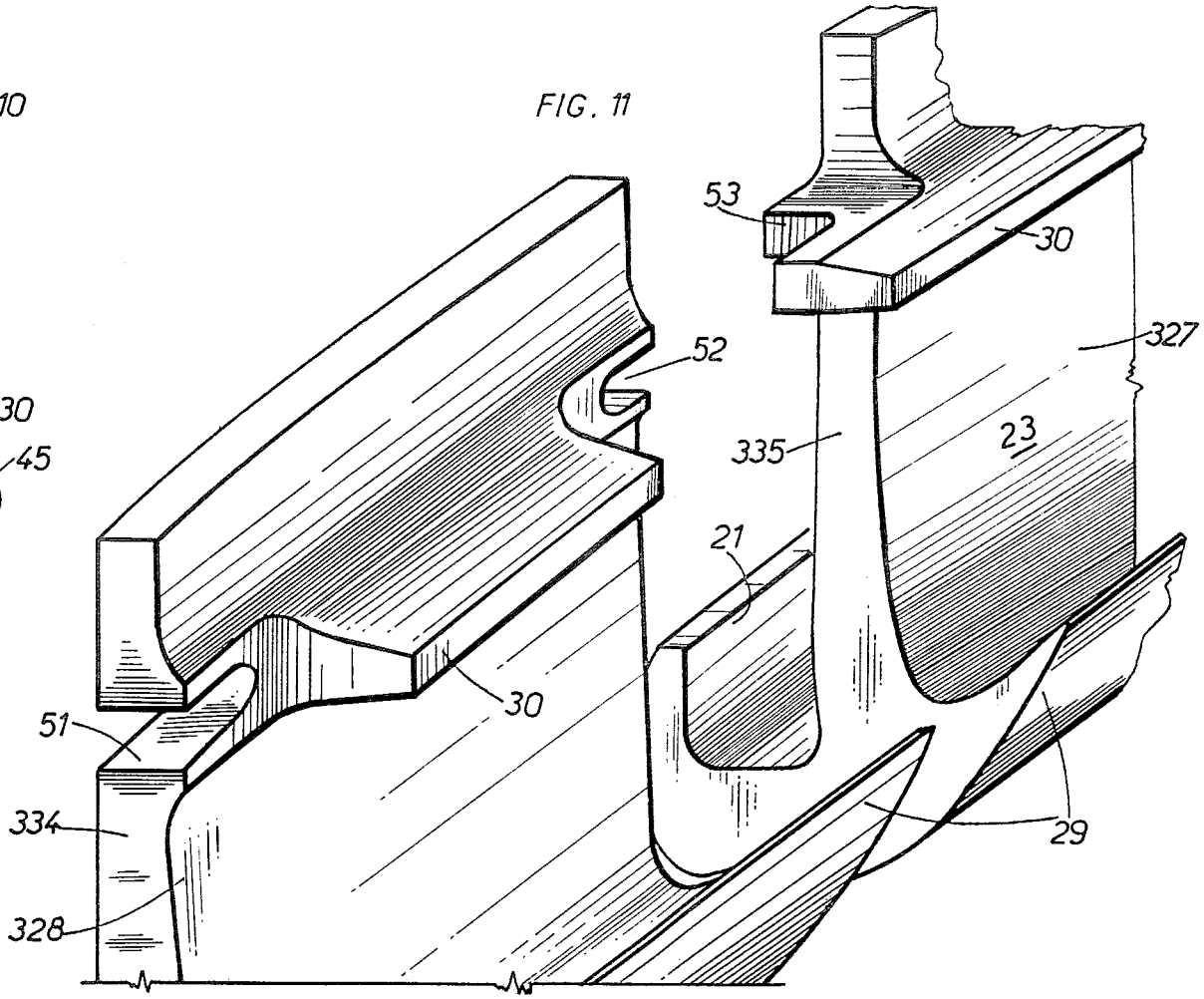
FIG. 11 is a partial perspective view of another mode of execution.

In the embodiment of FIG. 11, the two cuts 334, 335 are parallel and the two flanks of the key 328 are each provided with a mortise 51, 52 wherein a tenon, such as 53 of the flank of the principal piece 327 is engaged. As seen in the drawing, the mortises and the tenons are provided at the radial position of the cylindrical appendix 30 of the downstream face of the flange 10 so that said appendix 30 is notched on both sides of the key to permit the tenons to engage the mortises from downstream to upstream. To install the key 328, it is mounted from the inside to the outside between the two flanks of the piece 327, after having drawing them slightly in the downstream direction utilizing the elasticity of the flange, so that the heel of the key covers the annular collar; subsequently, the flanks of the piece 327 are released, whereupon the tenons, such as 53, will lodge in the mortises 51 and 52.

We claim:

1. In an annular turbine engine having a rotor flange cooperating with a frontal face of the rim of a disk wherein said rim is provided with a radial flange defining a collar located between the said frontal face and a circular groove in said disc, said rotor flange being of U-shape in section with arms of unequal length and with its concavity facing radially outward, the short arm of the U forming a hook engaged in said circular groove and the longer arm forming an annular flange extending along said frontal face, the annular flange thus covering said collar, the improvement comprising; the annular flange being divided into two unequal sections forming respectively a principal piece extending over the major portion of its circumference and elastically engaging the said collar, and a smaller piece forming a key completing the flange following the installation of the principal piece, and retention means carried by at least one of said flange pieces to prevent said key from escaping said rim in a radially inward direction.

2. A flange according to claim 1, wherein the center of gravity of the right section of the annular flange is located in the longer arm of the U shape.

3. A flange according to claim 1 wherein said annular flange is locked in rotation by means of a spur on the annular flange portion of the principal piece, aligned axially with and engaged in a recess provided in the rim.

4. A flange according to claim 1 for a disk of a turbine engine wherein the rim of said turbine engine disk includes a plurality of cooling conduits opening onto said frontal face through a plurality of orifices, a portion of the annular flange being provided with at least one machined part resting tightly against the parts of said frontal face surrounding said orifices.

5. A flange according to claim 1 wherein the retention means comprise cuts in the ends of the key, such that they are maintained in place by the ends of the principal piece.

6. A flange according to claim 5, wherein the division between the principal piece and the key is formed on one side by a bevel cut inclined toward the inner periphery of the key, and on the other side by a broken line cut forming in the key a protruding outer part and a recessed inner part, with the bevelled portions formed in the key and the principal piece by said bevel cut, preferably having the shape of a truncated cone at their nose.

7. A flange according to claim 5, wherein the division between the principal piece and the key is formed on either side by bevel cuts inclined toward the inner periphery of the key, the flange being slotted by notches serving to increase its flexibility, and the bevelled parts of the key and the principal piece being preferably in the shape of a truncated cone at their nose.

8. A flange according to claim 6 or claim 7, wherein the bevel cuts are inclined at approximately 50° with respect to the radii of the annular flange.

9. A flange according to claim 5, wherein the cuts define on either side of the key essentially parallel flanks with said flanks being locked against the adjacent flanks of the principal piece by means of tenon and mortise formations.

10. A flange according to claim 5 wherein the cuts of the ends of the key are inclined toward the outer periphery of said key, and the retention means comprises an elastic hook, having bent ends which are engaged respectively, through a plurality of holes in the key, in recesses provided in the rim, said hook forming a protuberance serving to maintain it in position and engaging in a hollow of the key.

* * * * *

UNITED STATES PATENT AND TRADEMARK OFFICE

CERTIFICATE OF CORRECTION

PATENT NO. : 4,247,257

DATED : January 27, 1981

INVENTOR(S) : Josette Benoist, Pierre A. Glowacki and Gerard M.P. Mandet

It is certified that error appears in the above—identified patent and that said Letters Patent is hereby corrected as shown below:

On the title page the number of the French priority application should read 7806602

In column 4, line 46, 82 should read 8a

Signed and Sealed this

*Twelfth* Day of *May 1981*

[SEAL]

*Attest:*

RENE D. TEGTMEYER

*Attesting Officer*

*Acting Commissioner of Patents and Trademarks*